US007543459B1

(12) United States Patent
Sciortino

(10) Patent No.: US 7,543,459 B1
(45) Date of Patent: Jun. 9, 2009

(54) LEG SUPPORT ASSEMBLY FOR AN ICEMAKER

(76) Inventor: Ronald R. Sciortino, 101 River Rd., Jefferson, LA (US) 70121

( * ) Notice: Subject to any disclaimer, the term of this patent is extended or adjusted under 35 U.S.C. 154(b) by 0 days.

(21) Appl. No.: 11/047,392

(22) Filed: Jan. 31, 2005

Related U.S. Application Data

(60) Provisional application No. 60/540,172, filed on Jan. 29, 2004, provisional application No. 60/542,549, filed on Feb. 6, 2004.

(51) Int. Cl.
*F25C 5/12* (2006.01)

(52) U.S. Cl. ..... 62/320; 248/188.1

(58) Field of Classification Search ..... 62/340–356, 62/320; 241/DIG. 17; 248/677, 188.8, 188.1
See application file for complete search history.

(56) References Cited

U.S. PATENT DOCUMENTS

| | | | | | |
|---|---|---|---|---|---|
| 2,515,923 | A * | 7/1950 | Hansen | 241/92 |
| 3,929,376 | A * | 12/1975 | Kates | 297/445.1 |
| 4,380,298 | A * | 4/1983 | Harig | 211/189 |
| 4,394,984 | A * | 7/1983 | Hight et al. | 241/278.1 |
| 4,550,575 | A * | 11/1985 | DeGaynor | 62/308 |
| 4,655,403 | A * | 4/1987 | Sciortino | 241/92 |
| 5,662,298 | A * | 9/1997 | Collins | 248/188.1 |
| 6,739,560 | B1 * | 5/2004 | Pajerski | 248/188.5 |
| 2002/0096609 | A1 * | 7/2002 | Venegas, Jr. | 248/188.1 |

* cited by examiner

*Primary Examiner*—William E. Tapolcai

(57) ABSTRACT

A leg support assembly having a first pair of leg members and second pairs of leg members each having an A-line contour. The leg members of each pair are separated by an elevated crossbar of the A-line contour so that water flows thereunder. A top crossbar member of each pair serves to attach a pair to an end of the icemaker.

13 Claims, 3 Drawing Sheets

LEG SUPPORT ASSEMBLY FOR AN ICEMAKER

CROSS-REFERENCE TO RELATED APPLICATIONS

Priority of U.S. Provisional Patent Application Ser. No. 60/540,172, filed Jan. 29, 2004, incorporated herein by reference, is hereby claimed.

Priority of U.S. Provisional Patent Application Ser. No. 60/542,549, filed Feb. 6, 2004, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to icemakers and, more particularly, to a leg assembly for supporting the icemaker above a catch pan and allowing water to flow through the leg assembly.

2. General Background of the Invention

My original icemaker is described in U.S. Pat. No. 4,655,403, entitled "ICE SHAVING MACHINE WITH STABILIZATION MEANS," (incorporated herein by reference as if set forth below in full). This icemaker was supported by a pair of downwardly depending legs. The legs have a truncated trapezoidal shaped. The lower bar of the truncated trapezoidally-shaped leg would trap water in a catch pan and would develop scum thereabout.

The pan is sized larger than the icemaker and can be placed on a table top. The pan serves to catch the water formed by melted shavings collecting in the icemaker and as the block of ice melts. However, over time, scum and mold forms at the bottom of the legs, since the icemaker is sitting in water.

As can be appreciated, cleaning was awkward and cumbersome since the icemaker had to be lifted so the bottom of the icemaker leg and pan could be cleaned.

In order to overcome the entrapment of water in a catch pan, I developed a pan that included four raised platforms. Each truncated trapezoidally-shaped leg would rest on a pair of the four raised platforms so that the water can flow under the lower bar of each leg. As can be appreciated, a catch pan manufactured with the raised platforms is more time consuming and costly since the platforms must be generally aligned and leveled to prevent an imbalance in the support of the icemaker.

In view of the foregoing there is a continuing need for a leg support assembly that is adapted to fit within a catch pan, without raised platforms, and which allows water to flow around and through the assembly so that the water can be easily drained.

There is another continuing need for a leg support assembly that facilitates both the drainage of water away from the icemaker.

Furthermore, there is a continuing need for a leg support assembly that is structurally strong to support and stabilize the icemaker during vibrational forces resulting from a block of ice being shaved.

As will be seen more fully below, the present invention is substantially different in structure, methodology and approach from that of prior icemakers.

The following U.S. Patents are incorporated herein by reference: U.S. Pat. Nos. 2,515,923; 4,655,403.

BRIEF SUMMARY OF THE INVENTION

The preferred embodiment of leg support assembly of the present invention solves the aforementioned problems in a straight forward and simple manner.

Broadly, what is provided is a leg support assembly for use with an icemaker comprising: a first pair of leg members arranged to have an A-line contour and adapted to be affixed to a first end of said icemaker, wherein said leg members are separated by a first elevated crossbar; and, a second pair of leg members arranged to have said A-line contour and adapted to be affixed to a second end of said icemaker wherein said leg members of said second pair are separated by a second elevated crossbar.

The present invention further contemplates a leg support member comprising: a truncated trapezoidal rigid structure having a top crossbar member; first and second elongated side members coupled to first and second distal ends of said top crossbar member and depend downwardly therefrom; and a bottom crossbar having first and second sections aligned with a first horizontal plane and separated by an elevated crossbar member aligned with a second horizontal plane, the second horizontal plane above the first horizontal plan.

In view of the above, an object of the present invention is to provide a leg support assembly that is adapted to fit within a catch pan and which allows water to flow around and through the assembly so that the water can be rapidly and easily drained, such draining serves to minimize the formation of scum and mold.

A further object of the present invention is to provide a leg support assembly that is structurally strong to support and stabilize the icemaker during vibrational forces resulting from a block of ice being shaved.

A still further object of the present invention is to provide a leg support assembly that facilitates the drainage of water away from the icemaker.

In view of the above, a feature of the present invention to provide a leg assembly that is relatively simple to manufacture.

Another feature of the present invention is to provide a leg assembly that is simple to install on new and existing icemakers.

A still further feature of the present invention is to provide a leg assembly that allows icemakers to be install in a standard catch pan having a generally flat planar surface.

The above and other objects and features of the present invention will become apparent from the drawings, the description given herein, and the appended claims.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
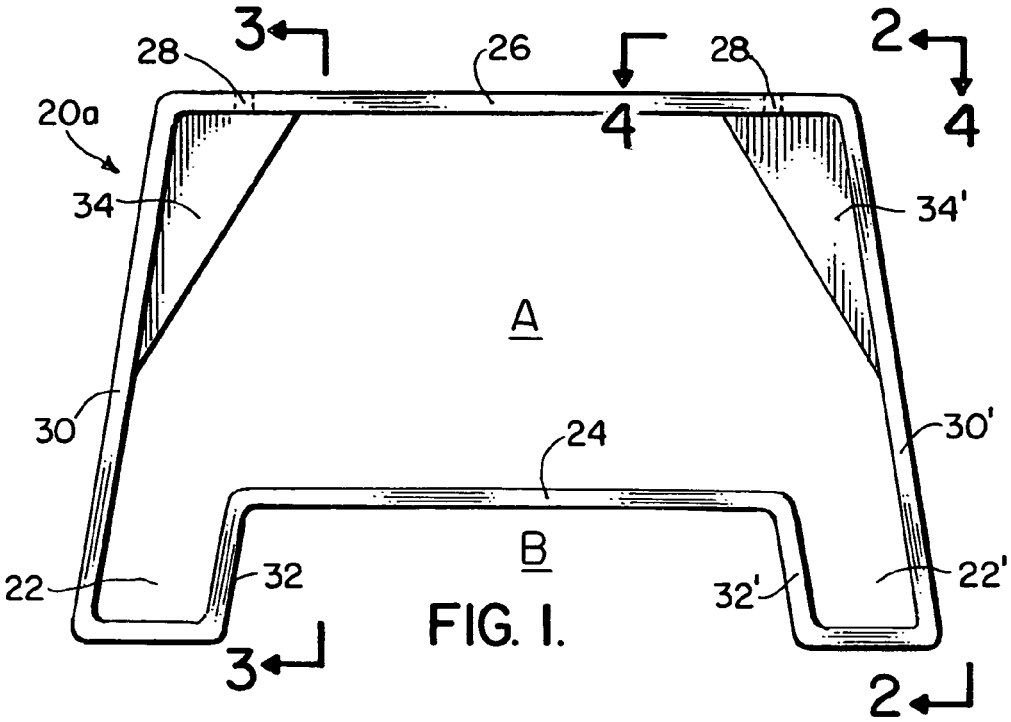
FIG. 1 illustrates a front view of the leg support member in accordance with the present invention.
Figure 2:
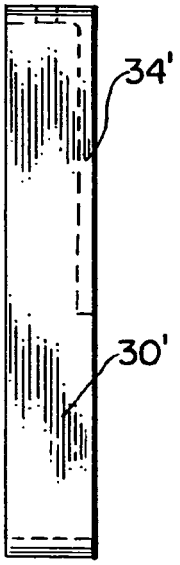
FIG. 2 illustrates a cross-sectional view along the plane 2—2 of the embodiment of FIG. 1.
Figure 3:
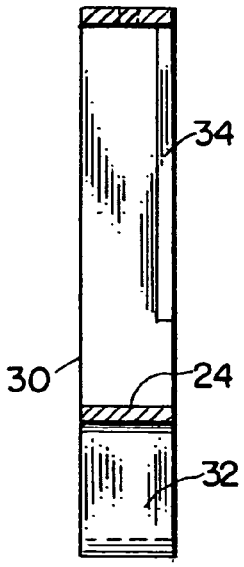
FIG. 3 illustrates a cross-sectional view along the plane 3—3 of the embodiment of FIG. 1.
Figure 4:
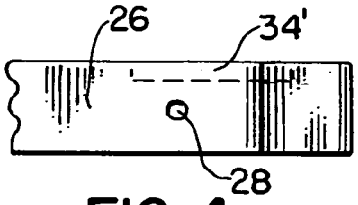
FIG. 4 illustrates a cross-sectional view along the plane 4—4 of the embodiment of FIG. 1.

Referring now to FIGS. 1–6, the leg support assembly of the present invention is designated by the reference numeral 10. The leg support assembly 10 is generally comprised of a pair of leg support members 20*a* and 20*b* adapted to be affixed to the bottom of icemaker 50.

Since the leg support members 20*a* and 20*b* are essentially identical, only one such leg support member 20*a* will be described in detail. Leg support member 20*a* is a contoured frame of structurally rigid material forming side-by-side legs 22 and 22' separated by a lower elevated crossbar 24. The elevated crossbar 24 allows water to flow thereunder as water is drained from catch pan 55. The leg support member 20*a* further comprises a top crossbar 26 essentially parallel to the elevated crossbar 24. The top crossbar 26 has formed therein apertures 28 for attaching the leg support member 20*a* to an end of the icemaker 50.

Regarding the side-by-side legs 22 and 22', the legs 22 and 22' are created by first and second elongated frame members 30 and 30', respectively, depending downwardly from respective opposite ends of the top crossbar 26. In the exemplary embodiment, the first and second elongated side-frame members 30 and 30' are not parallel and each forms an obtuse angle with the top crossbar 26. In general, the first and second elongated side-frame members 30 and 30', together, are arranged to follow an A-line contour from the top crossbar 26.

The contour of the leg 22' is completed by an "L"-shaped frame section 32' coupled to the bottom distal end of the second elongated side-frame member 30' and the adjacent distal end of the elevated crossbar 24. On the other hand, the contour of the leg 22 is completed by an "L"-shaped frame section 32, rotated approximately 180°, coupled to the bottom distal end of the first elongated side-frame member 30 and the adjacent distal end of the elevated crossbar 24.

In the exemplary embodiment, the angle formed by the legs of the "L"-shaped frame section 32 or 32' is an obtuse angle, instead of a right angle. However, the angle formed with the first elongated side-frame member 30 and its "L"-shaped frame section 32 is an acute angle. Likewise, the angle formed with the second elongated side-frame member 30' and its "L"-shaped frame section 32' is an acute angle. One leg (the horizontal sectional member) of each of the "L"-shaped frame sections 32 and 32' is aligned to be parallel with the horizontal plane and rests on the catch pan 55.

With reference to the catch pan 55, the catch pan 55 is a generally rectangularly-shaped pan. The catch pan 55 has a rectangular flat panel 55*a* surrounded by a low upright perimeter wall 55*b*. In the preferred embodiment, the catch pan 55 is laid on top of a table top. The table top has one end slightly elevated above the other by an angle α, and the front elevated above the back by an angle β, so that the collected water 1 in the catch pan 55 can drain out through outlet 55*c*. A hose or other conduit can be connected to outlet 55*c*.

The leg support assembly 10 further comprises first and second corner supports 34 and 34'. The first corner support 34 is coupled to the first elongated side-frame member 30 and the top crossbar member 26. The second corner support 34' is coupled to the second elongated side-frame member 30' and the top crossbar member 26.

Figure 5:
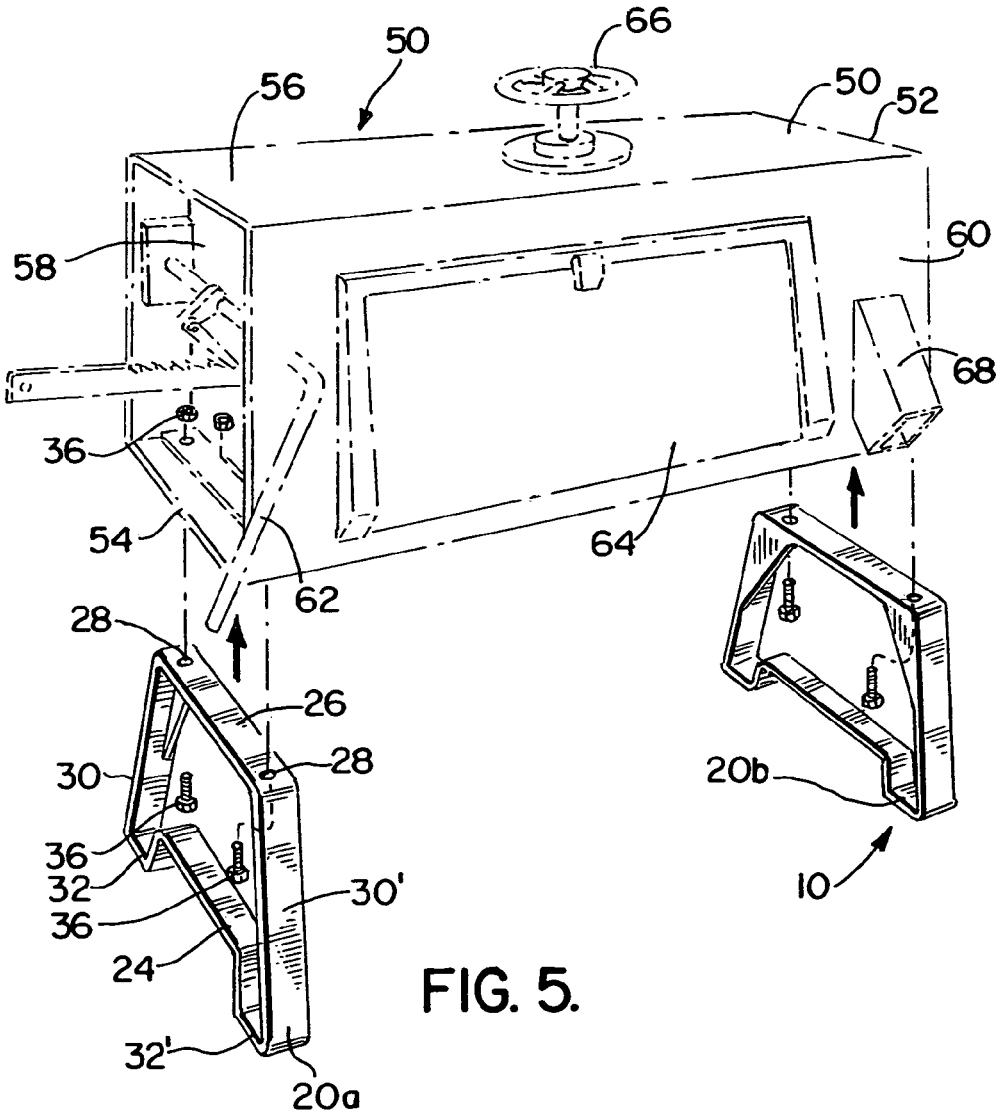
FIG. 5 illustrates an exploded view of an icemaker, shown in phantom, with the leg support assembly in accordance with the present invention; and, FIG. 6 illustrates the icemaker with the leg support assembly sitting within a catch pan.
Figure 6:
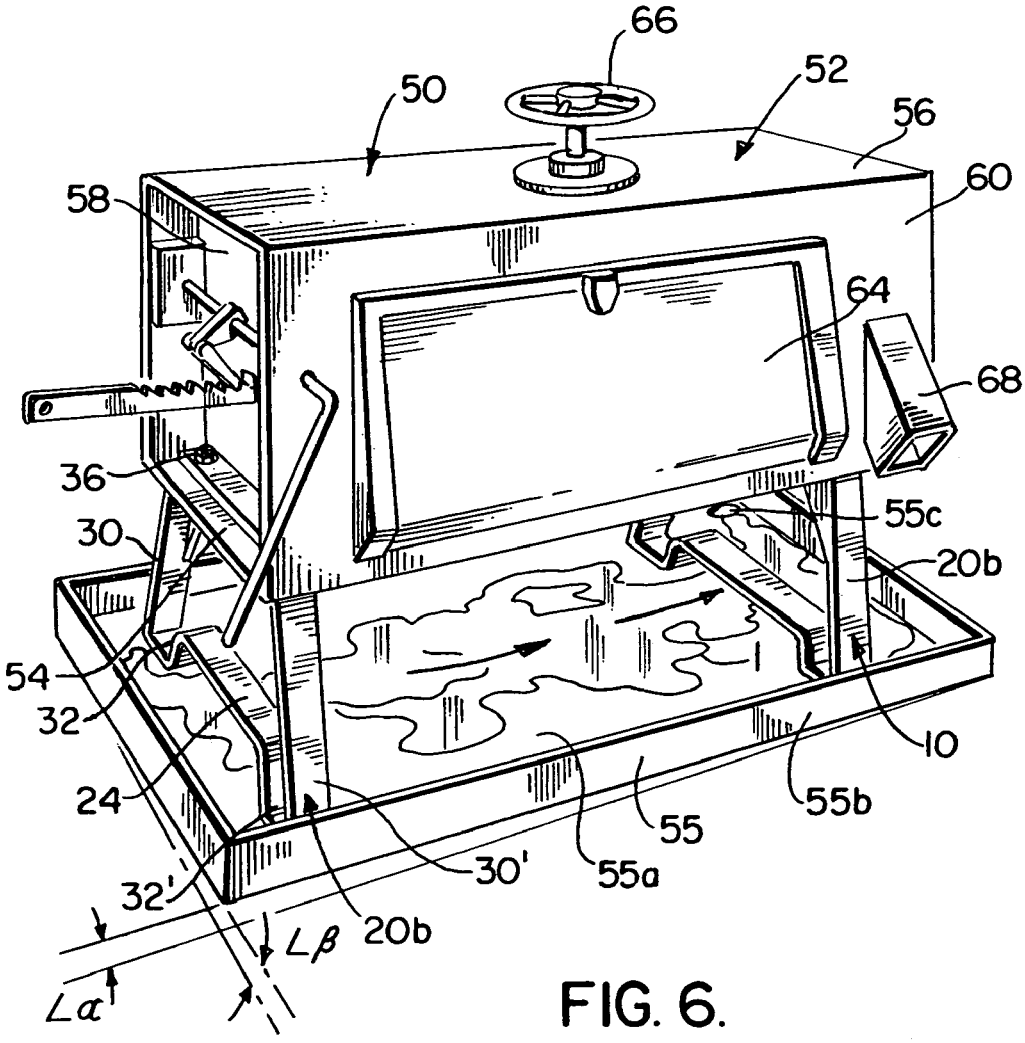

The icemaker 50 produces ice cuttings that chute through exterior chute 68, as best shown in FIGS. 5 and 6, and fall into a paper cone held beneath the chute 68. The icemaker 50 includes an rectangular enclosure 52 comprised of a flat rectangular base 54, a flat rectangular top 56 and front and rear walls (only one wall shown) 58.

The rectangular enclosure 52 also includes front and back side walls 60 (only the front wall shown). The front wall 60 has formed therein an opening closeable by door 64 and has coupled thereto a handle 62. The handle 62 functions to advance a pusher plate (NOT SHOWN) which in turn advances the block of ice. The top flat rectangular top 56 has coupled thereto a circular handle 66 which is secured to a plate (NOT SHOWN) in the interior of the rectangular enclosure 52, such plate is adapted to apply pressure on top of the block of ice.

In operation, door 64 is opened and a pusher plate (NOT SHOWN) is retracted in order to install a block of ice. Thereafter, the door 64 is closed. Once the door 64 is closed the user can then rotate handle 62 causing the ice block to be shaved in the manner as described in U.S. Pat. No. 4,655,403, entitled "ICE SHAVING MACHINE WITH STABILIZATION MEANS". As the block is shaved, cutting are channeled through the exterior chute 68 into a paper cone.

As can be appreciated, once the paper cone is filled and a snowball formed or as shavings free fall out through the chute 68, ice shaving residue adhering to the interior walls of chute 68 and those shavings collecting in the catch pan 55 melt. The slanted catch pan 55 allows the water and/or shavings to slide along the rectangular flat panel 55*a* toward outlet 55*c*.

The block of ice also melts. Thus, the water flowing out of enclosure 52 is also collected in catch pan 55. Hence, the water created by the melting block of ice also freely flows toward the end of the catch pan 55 having the outlet 55*c*.

The leg support member 10 can be described as a truncated trapezoidal rigid structure having a top crossbar member 26, first and second elongated (frame) side members 30 and 30' coupled to first and second distal ends of the top crossbar member 26 and depend downwardly therefrom; and a bottom crossbar having first and second sections aligned with a first horizontal plane (the horizontal component of the "L"-shaped frame section 32 or 32') and separated by an elevated crossbar member 24 aligned with a second horizontal plane. The second horizontal plane is above the first horizontal plan.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A leg support assembly for use with an icemaker comprising:

a first pair of leg members arranged to have an A-line contour and adapted to be affixed to a first end of said icemaker, wherein said leg members are separated by a first elevated crossbar for the flow of draining water thereunder; and, a second pair of leg members arranged to have said A-line contour and adapted to be affixed to a second end of said ice maker wherein said leg members of said second pair are separated by a second elevated crossbar for the flow of said draining water thereunder, wherein:

said first pair of said leg members comprises:

a first top crossbar member, first and second elongated side members coupled to first and second distal ends of said first top crossbar member and depend downwardly therefrom, a first "L"-shaped member which is rotated approximately 180° and which is coupled to said first elongated side member and a first distal end of said first elevated crossbar member, and a second "L"-shaped member coupled to said second elongated side member and a second distal end of said first elevated crossbar member; and, said second pair of said leg members comprises:

a second top crossbar member, third and fourth elongated side members coupled to first and second distal ends of said second top crossbar member and depend downwardly therefrom, a third "L"-shaped member which is rotated approximately 180° and which is coupled to said third and fourth elongated side members and a first distal end of said second elevated crossbar member, and a fourth "L"-shaped member coupled to said fourth elongated side member and a second distal end of said second elevated crossbar member.

2. The assembly of claim 1, wherein:

said first and second "L"-shaped members each includes first and second legs which from an obtuse angle therebetween wherein one leg of said first and second legs is aligned substantially parallel with a horizontal plane; and, said third and fourth "L"-shaped members each includes third and fourth legs which from an obtuse angle therebetween wherein one leg of said third and fourth legs is aligned substantially parallel with the horizontal plane.

3. The assembly of claim 1, wherein:

first and second elongated side members form first and second obtuse angles with said first and second distal ends of said first top crossbar member; and, third and fourth elongated side members form third and fourth obtuse angles with said first and second distal ends of said second top crossbar member.

4. The assembly of claim 1, further comprising:

first and second corner supports, said first corner support coupled to said first elongated side member and said first distal end of said first top crossbar member and said second corner support coupled to said second elongated side member and said second distal end of said first top crossbar member; and, third and fourth corner supports, said third corner support coupled to said third elongated side member and said first distal end of said second top crossbar member and said fourth corner support coupled to said fourth elongated side member and said second distal end of said second top crossbar member.

5. The assembly of claim 1, wherein said first and second top crossbar members each comprises:

a plurality of aperture for affixing adapted to receive fasteners for attachment to said icemaker.

6. The assembly of claim 1, wherein said first pair of leg members and said second pair of leg members are made of a structurally rigid material.

7. An icemaker comprising:

means for creating ice shavings; and, a leg support assembly for supporting said ice shaving creating means, said leg support assembly including:

a first pair of leg members arranged to have an A-line contour and adapted to be affixed to a first end of said icemaker, wherein said leg members are separated by a first elevated crossbar, and a second pair of leg members arranged to have said A-line contour and adapted to be affixed to a second end of said icemaker wherein said leg members of said second pair are separated by a second elevated crossbar, wherein said first pair of leg members comprises:

a first top crossbar member, first and second elongated side members coupled to first and second distal ends of said first top crossbar member and depend downwardly therefrom, a first "L"-shaped member which is rotated approximately 180 degrees and which is coupled to said first elongated side member and a first distal end of said first elevated crossbar member, and a second "L"-shaped member coupled to said second elongated side member and a second distal end of said first elevated crossbar member; and, a second top crossbar member, third and fourth elongated side members coupled to first and second distal ends of said second top crossbar member and depend downwardly therefrom, a third "L"-shaped member which is rotated approximately 180 degrees and which is coupled to said third and fourth elongated side members and a first distal end of said second elevated crossbar member, and a fourth "L"-shaped member coupled to said fourth elongated side member and a second distal end of the said second elevated crossbar member.

8. The icemaker of claim 7, wherein:

said first and second "L"-shaped members each includes first and second legs which from an obtuse angle therebetween wherein one leg of said first and second legs is aligned substantially parallel with a horizontal plane; and, said third and fourth "L"-shaped members each includes third and fourth legs which from an obtuse angle therebetween wherein one leg of said third and fourth legs is aligned substantially parallel with the horizontal plane.

9. The icemaker of claim 7, wherein:

first and second elongated side members form first and second obtuse angles with said first and second distal ends of said first top crossbar member; and, third and fourth elongated side members form third and fourth obtuse angles with said first and second distal ends of said second top crossbar member.

10. The icemaker of claim 7, further comprising:

first and second corner supports, said first corner support coupled to said first elongated side member and said first distal end of said first top crossbar member and said second corner support coupled to said second elongated side member and said second distal end of said first top crossbar member; and, third and fourth corner supports, said third corner support coupled to said third elongated side member and said first distal end of said second top crossbar member and said fourth corner support coupled to said fourth elongated side member and said second distal end of said second top crossbar member.

11. The icemaker of claim 7, wherein said first and second top crossbar members each comprises:

a plurality of aperture for affixing adapted to receive fasteners for attachment to said icemaker.

12. The icemaker of claim 7, further comprising:

a first open area formed between said first top crossbar members and said first elevated crossbar member;

a second open area formed below said first elevated cross bar member;

a third open area formed between said second top crossbar members and said second elevated crossbar member; and, a fourth open area formed below said second elevated cross bar member.

13. The icemaker of claim 7, wherein said first pair of leg members and said second pair of leg members are made of a structurally rigid material.

* * * * *